US006152108A

United States Patent [19]

Adachi et al.

[11] Patent Number: 6,152,108

[45] Date of Patent: Nov. 28, 2000

[54] THROTTLE CONTROLLER

[75] Inventors: Kazumasa Adachi; Yoshinori Taguchi, both of Aichi-ken, Japan

[73] Assignee: Aisin Seiki Kabushiki Kaisha, Kariya, Japan

[21] Appl. No.: 09/163,159

[22] Filed: Sep. 30, 1998

[30] Foreign Application Priority Data

Sep. 30, 1997 [JP] Japan ..... 9-265919

[51] Int. Cl.[7] ..... F02D 11/10; F02D 41/02

[52] U.S. Cl. ..... 123/399; 251/129.04

[58] Field of Search ..... 123/399, 361, 123/350; 251/129.04

[56] References Cited

U.S. PATENT DOCUMENTS 5,606,950 3/1997 Fujiwara et al. ..... 123/399

FOREIGN PATENT DOCUMENTS 63-150449 6/1988 Japan .
6-241098 8/1994 Japan .
7-269391 10/1995 Japan .

*Primary Examiner*—Andrew M. Dolinar
*Attorney, Agent, or Firm*—Sughrue, Mion, Zinn, Macpeak & Seas, PLLC

[57] ABSTRACT

The present throttle controller may generate the exact driving force to hold the target position between the fully closed and the fully opened positions of the throttle valve since a position holding factor is calculated based on the target position. Accordingly, the throttle valve may hold at the target position without any help of reduction mechanism between the motor and the throttle valve. Further, the position holding factor takes a larger value than that of the actual position while the target position is more opened than the actual positron. Such larger position holding factor boosts the throttle valve to promptly reach the target position. On the contrary, the position holding factor takes a smaller value than that of the actual position while the target position is more closed than that of the actual position. Such smaller position holding factor also boosts the throttle valve to reach the target position promptly. Accordingly, in the present invention, the throttle valve may settle at the target position promptly.

5 Claims, 4 Drawing Sheets

THROTTLE CONTROLLER

BACKGROUND OF THE INVENTION

This application claims priority under 35 U.S.C. §§119 and/or 365 to "THROTTLE CONTROLLER," Application No. H09-265919 filed in JAPAN on Sep. 30, 1997, the entire content of which is herein incorporated by reference.

This invention relates to a throttle controller which is capable of opening and closing a throttle valve under electronic control. More particularly, this invention relates to a throttle controller having a holding torque to keep the throttle valve at the target position.

Japanese Laid-Open Publication No. H07-269391 discloses a conventional throttle controller. In this publication, the throttle valve controller comprises a D.C. motor for opening and closing the throttle valve, a position detector for detecting an actual position of the throttle valve, a target position setting means for determining a target position in accordance with acceleration slip of a driving wheel, a difference operating means for calculating a difference between the actual position and the target position, a driving force setting means for determining a driving force (or level of supplied current) of the D.C. motor and a motor driving means for driving the D.C. motor with the set driving force.

Further, in this publication, the throttle valve controller continues to supply electric current to the D.C. motor to keep the throttle valve at the target position against pressure in the intake manifold after the throttle valve reaches the target position. Due to the supply of the electric current, the throttle valve may be kept at the target position without providing any reduction mechanism between the D.C. motor and the throttle valve. In this publication, the supply of the electric current may take either one of two predetermined levels to keep the throttle valve at the target position against pressure in the intake manifold. One predetermined level is employed for opening the throttle valve. The other predetermined level is employed for closing the throttle valve.

However, in this publication, no return spring is provided for the throttle valve to fully close the throttle valve upon termination of the supply of the electric current. If a return spring was provided, the spring force would increase in accordance with the amount of opening of the throttle valve. Therefore, in the conventional throttle controller, the throttle valve may not be kept reliably at the target position against the spring force since the supply of the electric current is set at the predetermined level regardless of the increase of the spring force.

SUMMARY OF THE INVENTION

The present invention provides a new and improved throttle controller which overcomes the drawbacks of the prior art.

The present invention provides a new and improved throttle controller which is capable of keeping the throttle valve at a target position, controlling the motor in accordance with the throttle valve position and cancelling undesirable spring force.

To achieve the above objects, a throttle controller of the present invention comprises a throttle valve movable between a fully closed position and a fully opened position, a motor for opening and closing the throttle valve, a bias member for urging the throttle valve toward the fully closed position, a position detector for detecting an actual position of the throttle valve, a target position setting means for determining a target position, a difference operating means for calculating a difference between the actual position and the target position, a driving force setting means for determining a driving force of the motor and a motor driving means for driving the motor with the set driving force, wherein the driving force setting means includes a PID operating means for calculating proportional, integral and derivative factors based on the difference, a position keeping means for calculating a position holding factor based on the target position and an operation means for adding the proportional, integral, derivative and position holding factors.

In the present throttle controller, the throttle valve receives a driving force corresponding to the position holding factor since the proportional, integral and derivative factors are nearly zero while the actual position approaches the target position. The present throttle controller may generate the exact driving force to hold the target position between the fully closed and the fully opened positions since the position holding factor is calculated by the position keeping means based on the target position. Accordingly, the throttle valve may hold at the target position without any reduction mechanism between the D.C. motor and the throttle valve.

Further, the position holding factor takes a larger value than that of the actual position while the target position is more open than the actual position. Such a larger position holding factor boosts the throttle valve to reach the target position promptly. On the contrary, the position holding factor takes a smaller value than that of the actual position while the target position is more closed than the actual position. Such a smaller position holding factor also boosts the throttle valve to reach the target position promptly. Accordingly, in the present invention, the throttle valve may settle at the target position promptly.

The above and other objects, features and advantages of the present invention will be more apparent and more readily appreciated from the following detailed description of preferred exemplary embodiment of the present invention, taken in connection with the accompanying drawings.

DETAILED DESCRIPTION OF THE PREFERRED EMBODIMENT

Figure 1:
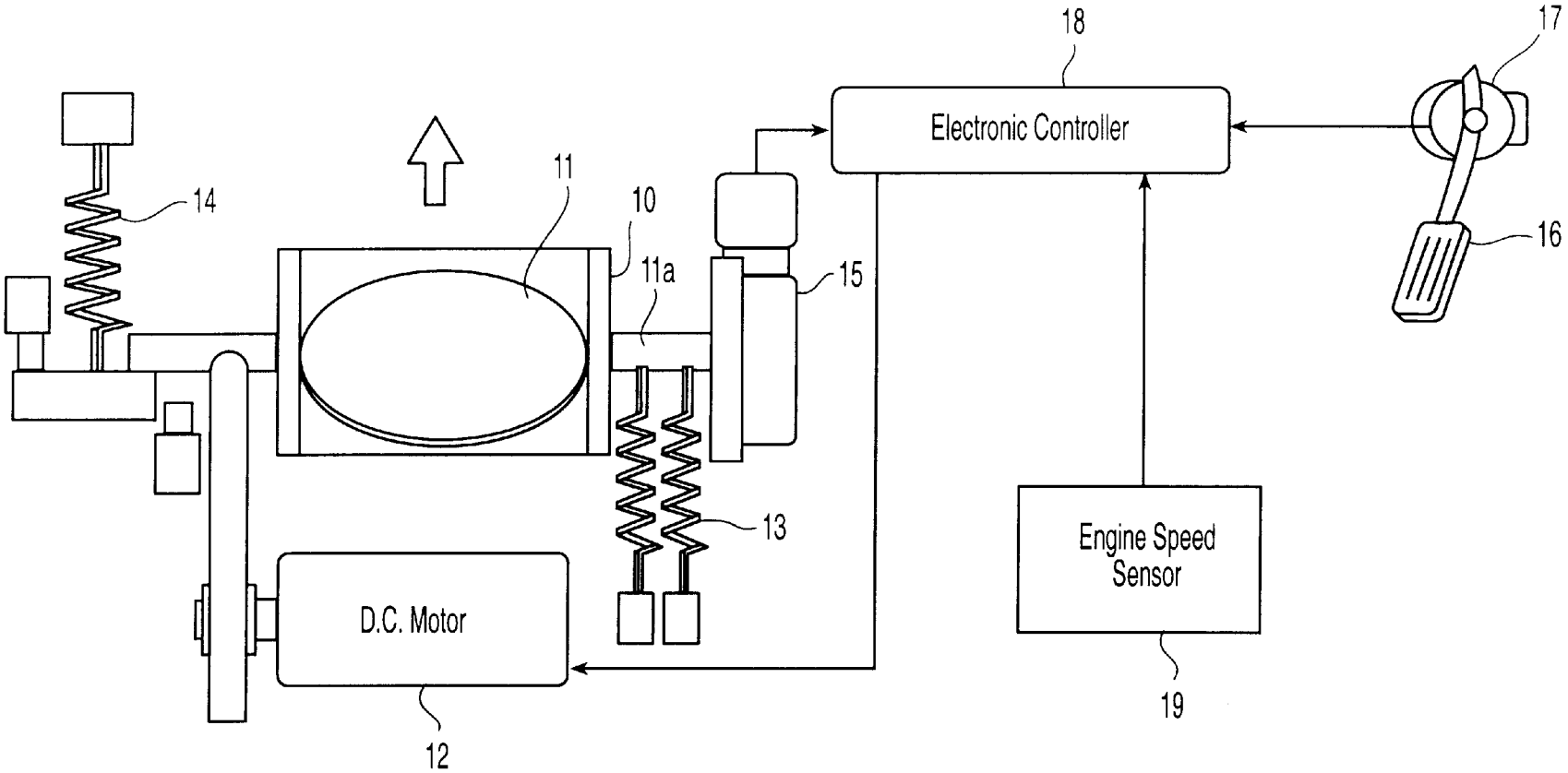
FIG. 1 is a block diagram showing an entire system according to the present invention.

As shown in FIG. 1, a throttle valve 11 is disposed in the intake manifold 10 of the internal combustion engine (not shown). The throttle valve 11 is fixed to the shaft 11*a* that is pivotally supported by the intake manifold 10. The throttle valve 11 is rotated to open and close the intake manifold 10. The throttle valve 11 is mechanically linked to a D.C. motor 12. The D.C. motor 12 drives the throttle valve 11 between a fully closed position and a fully opened position to control gas supply to the internal combustion engine.

Two return springs 13 are connected to the shaft 11*a*. Each return spring 13 put a torque on the throttle valve 11 toward the fully closed position. Further, an opener spring 14 is connected to the shaft 11*a*. The opener spring 14 puts a counter torque on the throttle valve 11 toward the fully opened position while the throttle valve 11 is positioned in a certain range between a predetermined position Θb and the fully closed position. The opener spring 14 also has an inflection point Θa between a balanced position Θc and the fully closed position. The opener spring 14 has a larger spring modulus than the return springs 13. Accordingly, the throttle valve 11 is held at the balanced position Θc where the torque from the return springs 13 balances the torque from the opener spring 14 while the D.C. motor 12 does not apply any driving torque to the throttle valve 11. At the balanced position Θc, a predetermined opening is preserved for idling rotation and a sure cold start of the internal combustion engine.

A position detector 15 is provided at one end of the shaft 11*a* to detect an actual throttle position ΘA. An accelerator position sensor 17 is connected to the accelerator pedal 16 to detect the driver's operation of the accelerator pedal 16. The engine speed sensor 19 is provided to detect current rotational speed of the internal combustion engine. The output signals from the position detector 15, the accelerator sensor 17 and the engine speed sensor 19 are fed to an electronic controller 18. The electronic controller 18 controls the driving torque of the D.C. motor 12.

Figure 2:
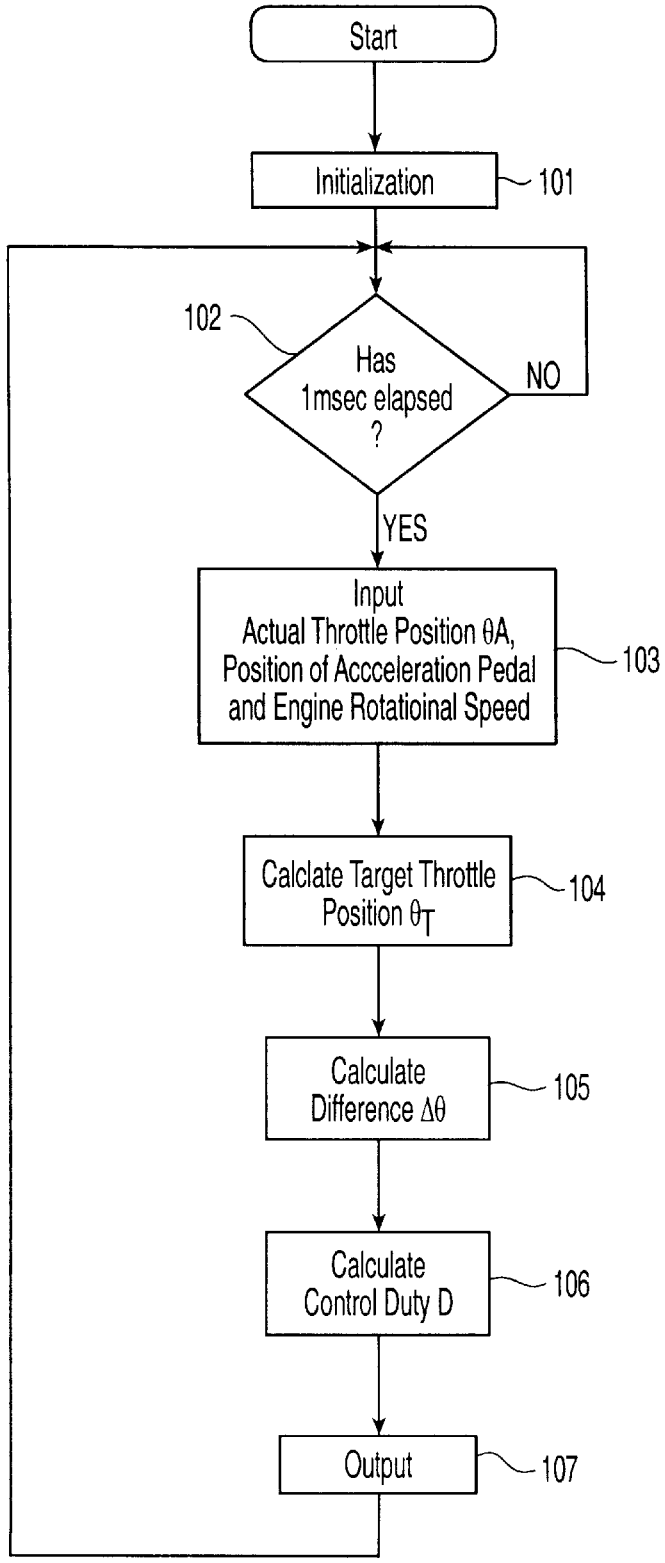
FIG. 2 is a flow chart showing a main routine executed by the electronic controller according to the present invention.
Figure 3:
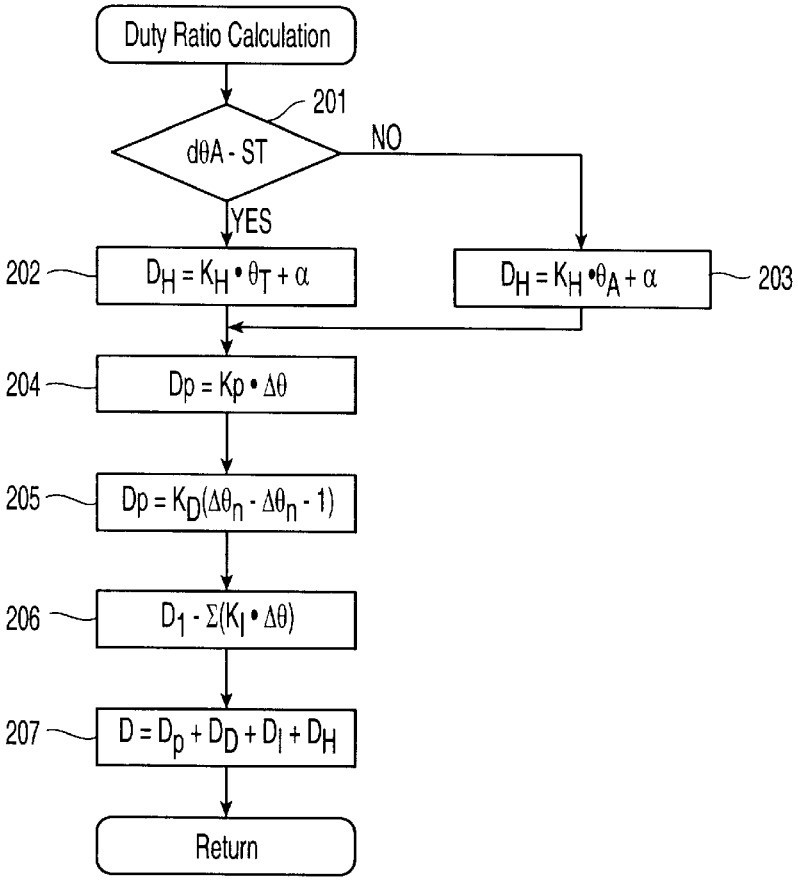
FIG. 3 is a flow chart showing a subroutine executed by the electronic controller according to the present invention.

Referring now to FIGS. 2 and 3, a program executed by the electronic controller 18 is explained in detail.

At step 101, an initialization process is executed to clear and initialize all data. At step 102, the electronic controller 18 waits for time up to maintain the control period of 1 msec. At step 103, an actual throttle position ΘA, a position of an acceleration pedal and an engine rotational speed are input from the position detector 15, the accelerator position sensor 17 and the engine speed sensor 19. At step 104, the electronic controller 18 calculates the target throttle position ΘT based on the current accelerator position and the engine rotational speed. The target throttle position ΘT may be calculated with additional sensors (not shown) for the acceleration slips of a driving wheels (i.e. traction control) or for target and actual body speeds (i.e. cruise control). At step 105, a difference ΔΘ is calculated with the expression of ΔΘ=ΘT−ΘA between the target throttle position ΘT and the actual throttle position ΘA of the throttle valve 11. At step 106, a control duty D is calculated to control the D.C. motor 12 based on the difference ΔΘ at step 107, the electronic controller 18 drives the D.C. motor 12 with the control duty D to reduce the difference ΔΘ to zero. The control duty D is a ratio between the power-on period and the power-off period of the D.C. motor 12. Step 102 is again executed after the step 107.

FIG. 3 is a flow chart showing a subroutine for the duty calculation at step 106.

At step 201, the electronic controller 18 calculates a differential amount dΘA that corresponds to differential calculus of the actual throttle position ΘA. Further, at step 201, the electronic controller 18 judges whether or not the differential amount dΘA is smaller than or equal to a constant ST. The constant ST is employed by the electronic controller 18 to judge whether or not the throttle valve is stationary. The differential amount dΘA becomes smaller than or equal to the constant ST while the throttle valve 11 substantially stops or moves very slowly. In case the throttle valve 11 substantially stops, a position holding factor $D_H$ is calculated based on the target throttle position $\Theta_T$ with expression $D_H=K_H\cdot\Theta_T+\alpha$. The position holding factor $D_H$ corresponds to a resultant torque of the return springs 13 and the opener spring 14. The position holding gain $K_H$ converts a position of the throttle valve 11 to the position holding factor $D_H$. An offset value α is set to adjust the position holding factor $D_H$. Step 203 is executed if the differential amount dΘA is larger than that of the constant ST at step 201. At step 203, the position holding factor $D_H$ is calculated based on the actual throttle position ΘA with expression $D_H=K_H\cdot\Theta A+\alpha$.

After the position holding factor $D_H$ is calculated at step 202 or 203, the electronic controller 18 executes steps 204, 205 and 206 to calculate a proportional factor $D_P$, an integral factor $D_I$ and a derivative factor $D_D$ based on the difference ΔΘ between the actual position $\Theta_A$ and target throttle position $\Theta_T$ of the throttle valve 11. In other words, at step 204, the proportional factor $D_P$ is calculated with expression $D_P=K_P\cdot\Delta\Theta$. At step 205, the derivative factor $D_D$ is calculated with expression $D_D=K_D(\Delta\Theta n-\Delta\Theta n-1)$. At step 206, the integral factor $D_I$ is calculated with expression $D_I\Sigma(K_I\cdot\Delta\Theta)$. The proportional gain $K_P$, derivative gain $K_D$ and integral gain $K_I$ are constants that convert a throttle position to respective factors. Further, the current difference ΔΘn is a variable for the present control period. The last difference ΔΘn−1 is a variable for the last control period.

Finally, at step 207, the electronic controller 18 adds the proportional factor $D_P$, the integral factor $D_I$ and the derivative factor $D_D$ so as to determine the control duty D. The electronic controller 18 returns to the main routine shown in FIG. 2 after the execution of step 207.

Figure 4:
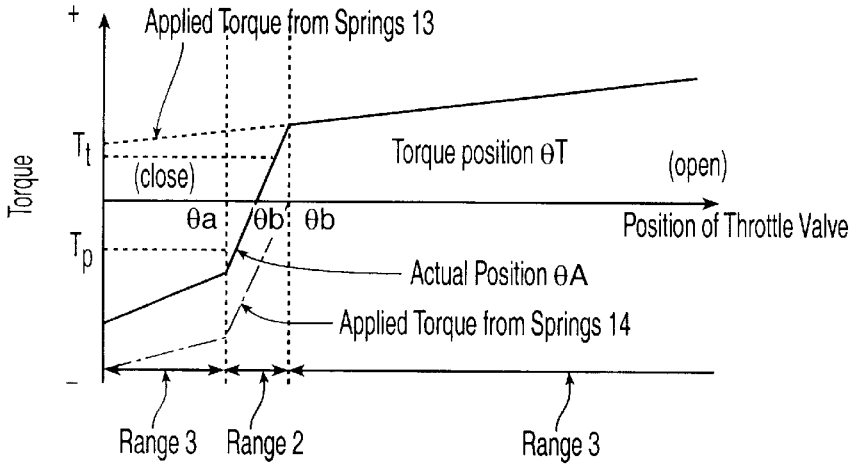
FIG. 4 is a graph showing a relationship between the actual throttle position and driving torque applied to the throttle valve according to the present invention.

As shown in FIG. 4, the throttle valve 11 receives torque from the return springs 13 and the opener spring 14. However, a change rate of the resultant torque depends on the actual throttle position ΘA. For example, the change rate in the range 2 (Θα<=ΘA<=Θb) is larger than those in the range 1 (ΘA<=Θa) and the range 3 (Θb<=ΘA).

As explained above, the electronic controller 18 calculates the position holding factor $D_H$ of the control duty D based on the target throttle position ΘT. Further, the position holding factor $D_H$ is set to generate a necessary target torque $T_t$ that corresponds to the resultant torque at the target throttle position ΘT. The necessary target torque $T_t$ is equivalent to the necessary control duty to minimize the difference ΔΘ. Therefore, even while the throttle valve 11 is in the range 2 where the change rate of the resultant torque is larger than the other ranges 1 and 3, the actual throttle position ΘA promptly reaches to the target throttle position ΘT since the target torque $T_t$ is larger than a position holding torque $T_P$ at the actual throttle position ΘA.

Figure 5:
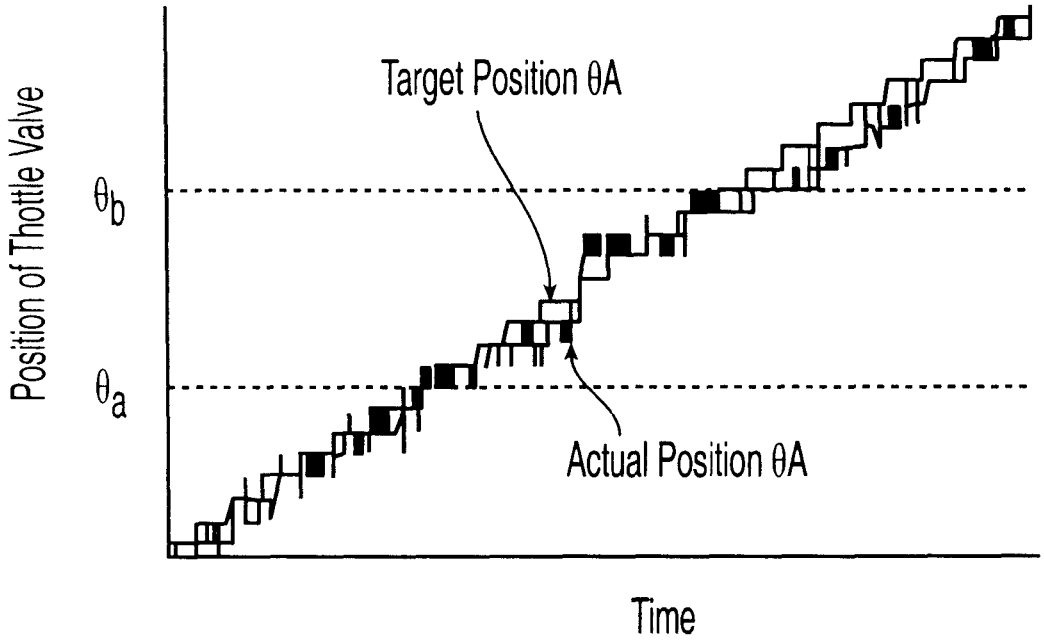
FIG. 5 is a graph showing a transition of the throttle valve according to the present invention.

FIG. 5 shows an experimental result of the present embodiment. In FIG. 5, the electronic controller 18 effectively reduces any constant error in the difference ΔΘ in all ranges of the actual throttle position ΘA.

In range 2, the same merits may be obtained by increasing the proportional, derivative and integral gains $K_P$, $K_D$ and $K_I$ from those in the ranges 1 and 3. However, determinations for the proportional, derivative and integral gains $K_P$, $K_D$ and $K_I$ may be more complicated.

Although the electronic controller 18 calculates the position holding factor $D_H$ based on the target throttle position ΘT, the electronic controller 18 may calculate the position holding factor $D_H$ based on the actual throttle position ΘA. In this case, the electronic controller 18 may still calculate the proportional factor $D_P$, the integral factor $D_I$ and the derivative factor $D_D$ based on the difference ΔΘ. Such electronic controller 18 demands relatively small driving torque to the D.C. motor 12 to reduce the difference ΔΘ.

While the throttle valve 11 is located in the ranges 1 and 3 where the changes of the resultant torque are relatively small, the electronic controller 18 may promptly reduce the difference ΔΘ with such a small driving torque. However, the electronic controller 18 may not promptly reduce the difference ΔΘ while the throttle valve 11 is located in the range 2 since the proportional factor $D_P$, the integral factor $D_I$ and the derivative factor $D_D$ in the range 2 keep the same values as those in the ranges 1 and 3. Accordingly, the actual throttle position ΘA may not reach the target throttle position ΘT promptly.

It may be possible to control the D.C. motor 18 by either duty ratio control or current level control. The duty ratio control may be preferable for the D.C. motor 18 to control the driving torque more efficiently.

In the present throttle controller, the throttle valve 11 receives a driving torque corresponding to the position holding factor $D_H$ since the proportional factor $D_P$, integral factor $D_I$ and derivative factor $D_D$ are nearly zero while the actual throttle position ΘA reaches to the target throttle position ΘT. The present throttle controller may generate the exact driving torque to hold the target throttle position ΘT in all ranges 1, 2 and 3 between the fully closed and the fully opened positions since the position holding factor $D_H$ is calculated by the electronic controller 18 based on the target throttle position ΘT. Accordingly, the throttle valve 11 may hold at the target throttle position ΘT without any help of reduction mechanism between the D.C. motor 12 and the throttle valve 11.

Further, in the present invention, the position holding factor $D_H$ is calculated based on the target throttle position ΘT. Therefore, the position holding factor $D_H$ takes a larger value than that of the actual throttle position ΘA in case the target throttle position ΘT is more opened than the actual throttle position ΘA. Such a larger position holding factor $D_H$ boosts the throttle valve 11 to reach the target throttle position ΘT promptly. On the contrary, the position holding factor $D_H$ takes a smaller value than that of the actual throttle position ΘA while the target throttle position ΘT is more closed than the actual throttle position ΘA. Such smaller position holding factor $D_H$ also boosts the throttle valve 11 to reach the target throttle position ΘT promptly. Accordingly, in the present invention, the throttle valve 11 may settle at the target throttle position ΘT promptly.

While the invention has been particularly shown and described with reference to preferred embodiments thereof, it will be understood by those in the art that the foregoing and other changes in form and details may be made therein without departing from the spirit and scope of the invention.

What is claimed is:

1. A throttle controller comprising:

a throttle valve moving between a fully closed position and a fully opened position;

a motor for opening and closing the throttle valve;

a bias member for urging the throttle valve toward the fully closed position;

a position detector for detecting an actual position of the throttle valve;

a target position setting means for determining a target position;

a difference operating means for calculating a difference between the actual position and the target position;

a driving force setting means for determining a driving force of the motor; and a motor driving means for driving the motor with the set driving force, wherein the driving force setting means includes:

a PID operating means for calculating proportional, integral and derivative factors based on said difference;

a position holding means for calculating a position holding factor based on the target position, said position holding factor corresponding to a driving force for holding the throttle valve at the target position when the throttle valve has substantially stopped at said target position; and an operation means for adding the proportional, integral, derivative and position holding factors.

2. A throttle controller according to claim 1, the position keeping means calculates the position holding factor based on the actual position while the throttle valve is substantially stopped.

3. A throttle controller for opening and closing a throttle valve comprising:

a bias member for urging the throttle valve toward the fully closed position;

a position detector for detecting an actual position of the throttle valve;

a target position setting means for determining a target position;

a difference operating means for calculating a difference between the actual position and the target position; and a driving means for opening and closing the throttle valve based on said difference;

wherein when said difference is zero, the driving means operates to apply, during movement a driving force to said throttle valve based on the driving face which cancels an urging force of said bias member when said difference is zero.

4. The throttle controller according to claim 3, wherein the driving means applies to the throttle valve a counter force based on the target position.

5. The throttle controller according to claim 3, wherein the driving means applies to the throttle valve a counter force based on the actual position.

* * * * *